US007382094B2

(12) United States Patent
Hong et al.

(10) Patent No.: US 7,382,094 B2
(45) Date of Patent: Jun. 3, 2008

(54) BUS ELECTRODES FOR PLASMA DISPLAY PANEL

(75) Inventors: Chong-Gi Hong, Asan-si (KR); Tae-Kyoung Kang, Asan-si (KR)

(73) Assignee: Samsung SDI Co., Ltd., Suwon (KR)

( * ) Notice: Subject to any disclaimer, the term of this patent is extended or adjusted under 35 U.S.C. 154(b) by 0 days.

(21) Appl. No.: 11/073,749

(22) Filed: Mar. 8, 2005

(65) Prior Publication Data

US 2005/0194901 A1 Sep. 8, 2005

(30) Foreign Application Priority Data

Mar. 8, 2004 (KR) ..... 10-2004-0015597

(51) Int. Cl.
*H01J 17/49* (2006.01)

(52) U.S. Cl. ..... 313/582; 313/584

(58) Field of Classification Search ..... 313/582, 313/583–587

See application file for complete search history.

(56) References Cited

U.S. PATENT DOCUMENTS 6,075,319 A * 6/2000 Kanda et al. ..... 313/584
6,097,149 A * 8/2000 Miyaji et al. ..... 313/582
6,191,530 B1 * 2/2001 Fukuta et al. ..... 313/586
6,276,980 B1 * 8/2001 Kim ..... 445/24
6,312,864 B1 * 11/2001 Tokai et al. ..... 430/198
6,517,400 B1 * 2/2003 Cho et al. ..... 445/24
2002/0048730 A1 * 4/2002 Hatori et al. ..... 430/322
2004/0174119 A1 * 9/2004 Fujitani ..... 313/586

FOREIGN PATENT DOCUMENTS

JP 2001084833 A * 3/2001
JP 2003-187709 7/2003
KR 10-2001-0111214 12/2001
KR 10-2001-0111215 12/2001

* cited by examiner

*Primary Examiner*—Joseph L. Williams
*Assistant Examiner*—Hana A Sanei
(74) *Attorney, Agent, or Firm*—H.C. Park & Associates, PLC

(57) ABSTRACT

A plasma display panel that includes a front substrate, and a sustain electrode formed on the front substrate. The sustain electrode comprises a transparent electrode and a bus electrode coupled to each other, and the bus electrode comprises conductive particles and adhesive particles. An average diameter of the conductive particles and an average diameter of the adhesive particles are less than 5 μm.

9 Claims, 2 Drawing Sheets

BUS ELECTRODES FOR PLASMA DISPLAY PANEL

CROSS REFERENCE TO RELATED APPLICATION

This application claims priority to and the benefit of Korean Patent Application No. 10-2004-0015597, filed on Mar. 8, 2004, which is hereby incorporated by reference for all purposes as if fully set forth herein.

BACKGROUND OF THE INVENTION

1. Field of the Invention

The present invention relates to a plasma display panel (PDP), and more particularly, to a PDP having an improved bus electrode structure.

2. Discussion of the Background

A PDP displays an image by exciting a phosphor layer with ultraviolet (UV) rays. The UV rays are generated during a glow discharge that occurs by applying a predetermined voltage to electrodes formed in a gas-filled, sealed discharge space.

Generally, the PDP includes facing front and rear panels joined together.

The front panel comprises a front substrate, a plurality of sustaining electrode pairs separated a predetermined distance on the front substrate, a front dielectric layer covering the sustaining electrode pairs, and a protection layer covering the front dielectric layer. Each sustaining electrode pair typically includes a common electrode and a scan electrode, and the common electrodes and the scan electrodes include a transparent electrode and a bus electrode. The bus electrode may be connected to the transparent electrode, and it applies a voltage to the transparent electrode.

The rear panel comprises a rear substrate facing the front substrate, a plurality of address electrodes formed on the rear substrate to cross to the sustaining electrode pairs, a rear dielectric layer covering the address electrodes, a plurality of barrier ribs formed on the rear dielectric layer to define discharge spaces and prevent cross-talk, and a plurality of red, green, and blue color phosphor layers coated in the discharge spaces defined by the barrier ribs.

In a PDP having the above structure, the bus electrode may be formed of a black electrode layer and a white electrode layer. The black electrode layer acts as a shielding film by being disposed close to the front substrate. Japanese Patent Laid-Open Publication No. 2003-187709 discloses technology related to the black electrode layer.

In a conventional bus electrode, average diameters of ruthenium (Ru)—conductive particles, which may form the black electrode layer, silver (Ag)—conductive particles, which may form the white electrode layer, and frit, which is adhesive particles included in the black and white electrode layers, are greater than 5 μm.

However, when the average diameters of the conductive and adhesive particles are greater than 5 μm, the size of pores between the particles increases. Hence, a large number of pin holes may be formed in the bus electrode, resulting in reduced bus electrode density, thereby reducing conductivity by increasing line resistance of the bus electrode. This problem may be severe when the average diameter of the adhesive particles is greater than the average diameter of the conductive particles.

To solve this problem, the bus electrode may be made thicker. However, increasing the thickness increases the material cost, and it may also cause edge-curls, which may occur when both ends of the bus electrode are thicker than a central area, which provides a non-uniform cross-sectional shape.

If the edge-curls are severe enough, a withstand voltage of the front dielectric layer may decrease. Therefore, the thickness of the front dielectric layer may be increased to supplement its withstand voltage. But this requires additional material cost.

SUMMARY OF THE INVENTION

The present invention provides a PDP having bus electrodes formed of a high density film to enhance their conductivity and secure a sufficient withstand voltage of a dielectric layer covering them.

Additional features of the invention will be set forth in the description which follows, and in part will be apparent from the description, or may be learned by practice of the invention.

The present invention discloses a PDP comprising a front substrate and a sustain electrode formed on the front substrate. The sustain electrode comprises a transparent electrode and a bus electrode coupled to each other, and the bus electrode comprises conductive particles and adhesive particles. An average diameter of the conductive particles and an average diameter of the adhesive particles are less than 5 μm.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

DETAILED DESCRIPTION OF THE ILLUSTRATED EMBODIMENTS

Figure 1:
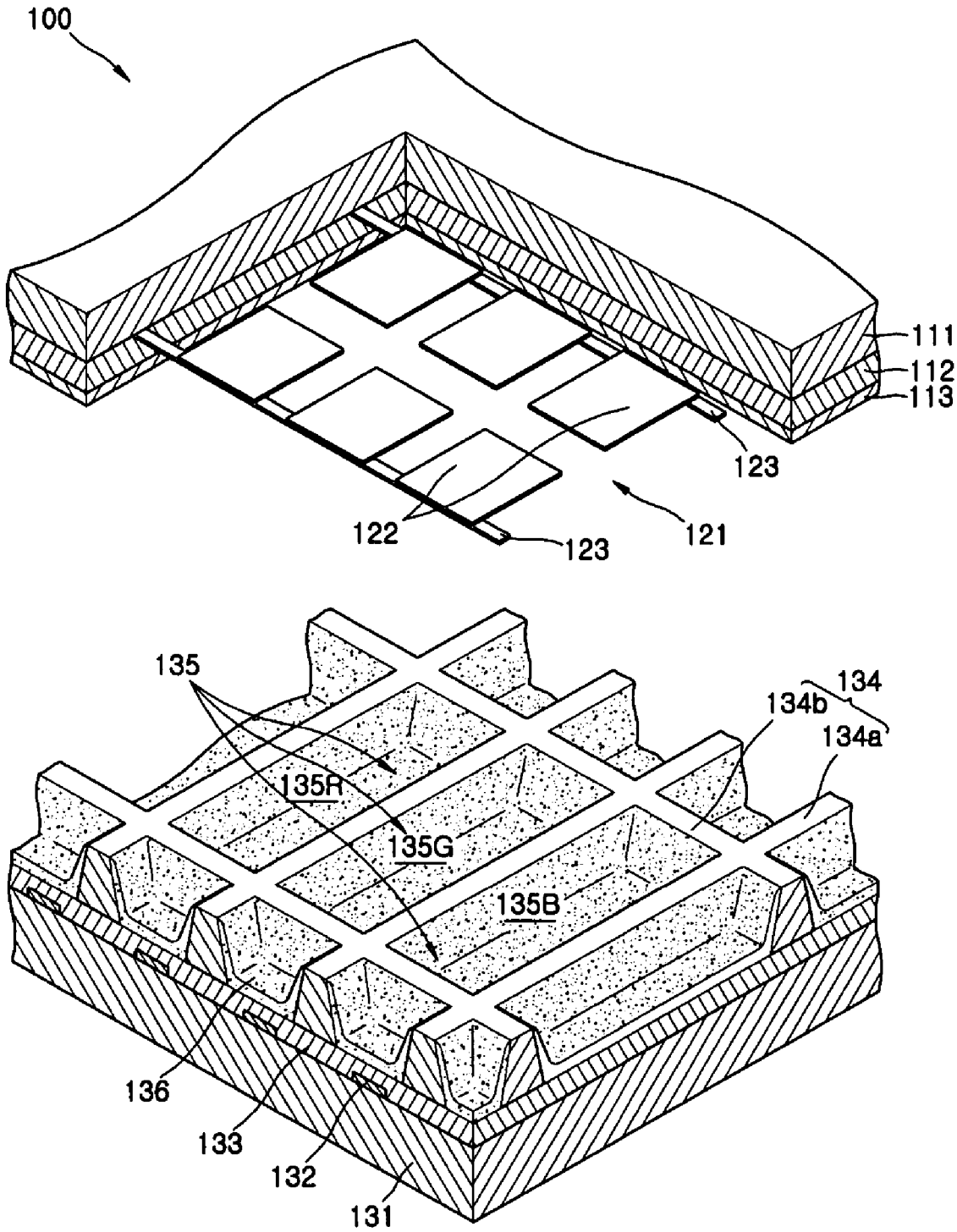
FIG. 1 is an exploded perspective view showing a PDP according to an exemplary embodiment of the present invention.
Figure 2:
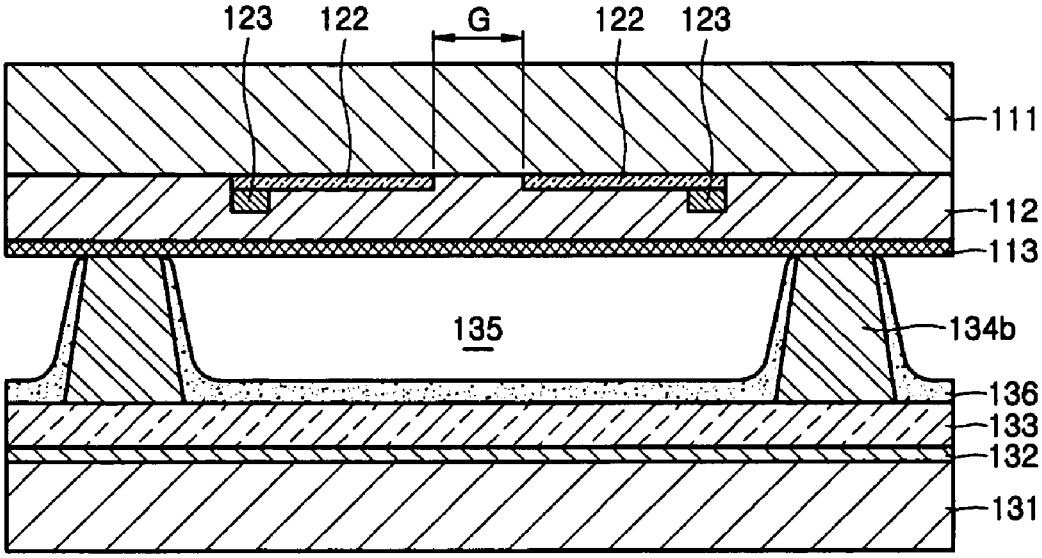
FIG. 2 is a cross-sectional view of the PDP in FIG. 1.

FIG. 1 is an exploded perspective view showing a PDP according to an exemplary embodiment of the present invention, and FIG. 2 is a cross-sectional view of the PDP in FIG. 1.

Referring to FIG. 1 and FIG. 2, the PDP 100 comprises a front substrate 111 and a rear substrate 131 facing each other. A plurality of pairs of sustaining electrodes 121 are formed on a surface of the front substrate 111 facing the rear substrate 131. A pair of the sustaining electrodes 121 comprises a common electrode "X electrode," and a scan electrode "Y electrode," with a discharge gap G, therebetween.

The sustaining electrodes 121 include a transparent electrode 122, which may be formed of indium tin oxide (ITO), and a bus electrode 123, which is coupled to the transparent electrode 122.

As shown in FIG. 1, the transparent electrode 122 may comprise a plurality of protrusions, and an end of each of the protrusions is coupled to the bus electrodes 123. The other ends corresponding protrusions form the discharge gap G. However, the structure of the transparent electrode 122 is not limited thereto.

A front dielectric layer 112 covers the pairs of sustaining electrodes 121, and a protection layer 113, which may be formed of magnesium oxide (MgO), covers the front dielectric layer 112.

Address electrodes 132 are formed on a surface of the rear substrate 131 facing the front substrate 111, and they cross the pairs of sustaining electrodes 121.

A rear dielectric layer 133 covers the address electrodes 132, and barrier ribs 134 are formed on the rear dielectric layer 133. The barrier ribs 134 define a plurality of discharge cells 135 and prevent cross-talk between adjacent discharge cells 135.

The barrier ribs 134 may include intersecting first barrier ribs 134*a* and second barrier ribs 134*b*. As shown in FIG. 1, the first barrier ribs 134*a* are disposed parallel to each other and in between the address electrodes 132.

The first and second barrier ribs 134*a* and 134*b* define a matrix of discharge cells 135. Defining the discharge cells 135 in a matrix shape may increase pine pitch, brightness, and emission efficiency. The barrier ribs 134 may be arranged in various patterns to define the discharge cells.

Phosphor layers 136 may be formed by coating a fluorescent material on a surface of the rear dielectric layer 133 and side surfaces of the barrier ribs 134. Red, green, and blue fluorescent materials may be used for displaying a color image. Red, green, and blue phosphor layers are formed according to the emitting light color of fluorescent material.

The discharge cells 135 may comprise red, green, and blue discharge cells 135R, 135G, and 135B, and three adjacent discharge cells 135R, 135G, and 135B may constitute a unit pixel. The discharge cells 135 are filled with a discharge gas, and the front substrate 111 and the rear substrate 131 are sealed together by a sealing member.

Figure 3:
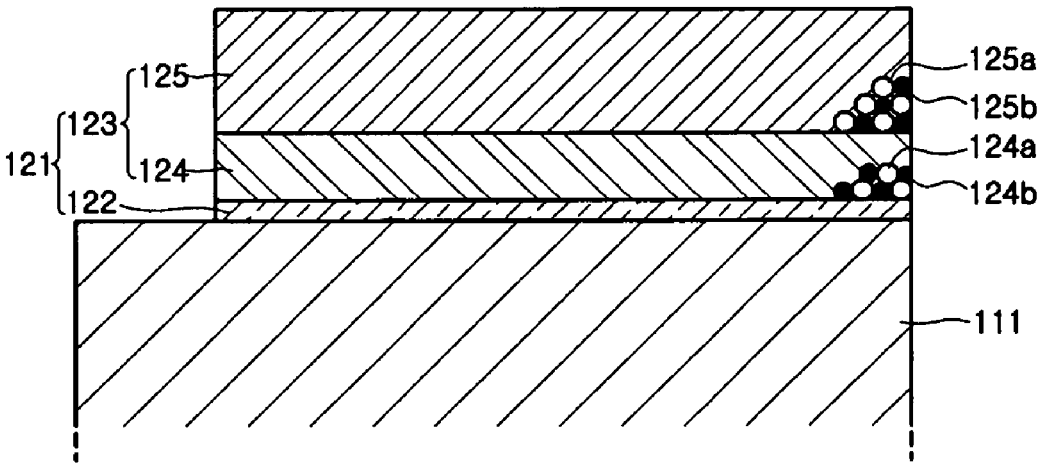
FIG. 3 is a cross-sectional view showing a bus electrode formed on a front substrate of the PDP of FIG. 1.

Referring to FIG. 3, the bus electrode 123 may include a first bus electrode layer 124 and a second bus electrode layer 125.

The first bus electrode layer 124 is coupled to the transparent electrode 122 by being disposed on the front substrate 111, and the second bus electrode layer 125 may be formed on the first bus electrode layer 124. The first bus electrode layer 124 is preferably greater than 0.4 μm thick so the panel's contrast is not reduced.

The first and second bus electrode layers 124 and 125 may be formed by coating, drying, and sintering a paste comprising conductive particles 124*a* and 125*a* and adhesive particles 124*b* and 125*b* (in a powder form), a binder, and a solvent. After removing the binder and the solvent by drying and sintering, the conductive particles 124*a* and 125*a* and adhesive particles 124*b* and 125*b* may be formed in the first and second bus electrode layers 124 and 125. Various methods for forming the first and second bus electrode layers 124 and 125 may be used.

The conductive particles 124*a* of the first bus electrode layer 124 may be formed of Ru, Co, or Mn, which are black in color and may absorb external light. The conductive particles 125*a* of the second bus electrode layer 125 may be formed of Ag, Al, or Au, which are white in color and may reflect visible light emitted from the phosphor layer 136.

The adhesive particles 124*b* and 125*b*, included in the first and second bus electrode layers 124 and 125, may be formed of a frit that agglomerates and surrounds the conductive particles 124*a* and 125*a*. The frit may be composed of PbO, $B_2O_3$, $SiO_2$, $Al_2O_3$, or $Bi_2O_2$.

According to an exemplary embodiment of the present invention, an average diameter of the conductive particles 124*a* and 125*a* is less than 5 μm, and an average diameter of the adhesive particles 124*b* and 125*b* is equal to or less than the average diameter of the conductive particles 124*a* and 125*a*.

Forming the conductive particles 124*a* and 125*a* and the adhesive particles 124*b* and 125*b* with an average diameter less than 5 μm allows the bus electrodes 123 to be formed in a high density film. Accordingly, as shown by the following examples, the bus electrode according to exemplary embodiments of the present invention may have superior line resistance, edge-curl value, and withstand voltage of the front dielectric layer as compared to the conventional art.

Comparative Example

According to the conventional art, a bus electrode is formed such that the average diameter of the Ru, which forms the first bus electrode layer, the average diameter of the Ag, which forms the second bus electrode layer, and the average diameter of the frit, which is included in the first and second bus electrode layers 124 and 125, are 5 μm. Another bus electrode is formed where the average diameters of the Ru and Ag is 5 μm and that of the frit is 6 μm.

Table 1 shows measurements of bus electrode thickness, line resistance, edge-curl value, and withstand voltage of the front dielectric layer for the conventionally formed bus electrodes.

In Table 1, the thickness of the bus electrode indicates the total thickness of the combined first and second bus electrode layers. The edge-curl value is the difference between the maximum and minimum thicknesses of the bus electrode. The line resistance of the bus electrode is measured based on a width of 80 μm and a length of 933 mm, and the withstand voltage of the front dielectric layer is measured based on a 36 μm thick front dielectric layer. These same conditions are also applied to the exemplary embodiments of the present invention in Example 1, Example 2, Example 3, Example 4 and Example 5.

TABLE 1

| Diameter of Ru (μm) | Diameter of Ag (μm) | Diameter of frit (μm) | Thickness of bus electrode (μm) | Line resistance (Ω) | Edge-curl value (μm) | Withstand voltage of front dielectric layer (V) |
|---|---|---|---|---|---|---|
| 5 | 5 | 5 | 13 | 80 | 5 | 850 |
| | | 6 | 14 | 84 | 5.5 | 820 |

Referring to Table 1, when the average diameters of Ru, Ag, and frit are 5 μm, the line resistance is 80Ω, the edge-curl is 5 μm, and the withstand voltage of the front dielectric layer is 850 V.

EXAMPLE 1

According to an exemplary embodiment of the present invention, the average diameter of Ru and the average diameter of Ag are formed to 4 μm, and the average diameter of the frit is formed to be less than 1 μm and 1 to 4 μm, in 1 μm increments.

Table 2 summarizes the measurement results of the Example 1 configurations.

TABLE 2

| Average Diameter of Ru (μm) | Average Diameter of Ag (μm) | Average Diameter of frit (μm) | Thickness of Bus electrode (μm) | Line resistance (Ω) | Edge-curl value (μm) | Withstand voltage of front dielectric layer (V) |
|---|---|---|---|---|---|---|
| 4 | 4 | 4 | 10.1 | 75 | 3.9 | 870 |
| | | 3 | 9.5 | 72 | 3.6 | 879 |
| | | 2 | 9.0 | 70 | 3.2 | 885 |
| | | 1 | 8.6 | 67 | 2.8 | 890 |
| | | Less than 1 | 8.2 | 65 | 2.6 | 903 |

Referring to Table 1 and Table 2, when the average diameters of the Ru, Ag, and frit are 4 μm, even though the bus electrode thickness decreases from 13 μm to 10.1 μm, the line resistance also decreases from 80Ω to 75Ω. This result indicates that the bus electrode may be formed with high density by reducing the average diameters of the conductive and adhesive particles. Accordingly, the line resistance of the bus electrode decreases even if the bus electrode is thinner since the pore sizes between the particles and the generation of pin holes are reduced.

Further, as shown by Table 1 and Table 2, as the bus electrode thins, the edge-curl decreases from 5 μm to 3.9 μm, and as the edge-curl value decreases, the withstand voltage increases from 850 V to 870 V.

According to exemplary embodiments of the present embodiment, forming a thin and dense bus electrode may reduce material costs for forming the bus electrode, and repair work may be reduced since the generation of pin holes in the bus electrode is reduced, thereby increasing productivity. Also, as the withstand voltage of the front dielectric layer increases, the front dielectric layer may be made thinner since there is low possibility of it breaking, thereby further reducing material costs.

Generally, when the average diameter of the frit decreases, the density of the bus electrode may increase, which is a desirable result. Also, when comparing bus electrode thickness, line resistance, edge-curl value, and withstand voltage of the front dielectric layer of the bus electrodes of Example 1, as the average diameter of the frit decreases, these characteristics become gradually more advantageous.

EXAMPLE 2

In Example 2, the average diameter of Ru and the average diameter of Ag are formed to be 3 μm, and the average diameter of the frit is formed to be less than 1 μm and 1 to 3 μm, in 1 μm increments.

Table 3 shows the measurement results.

TABLE 3

| Average Diameter of Ru (μm) | Average Diameter of Ag (μm) | Average Diameter of frit (μm) | Thickness of Bus electrode (μm) | Line resistance (Ω) | Edge-curl value (μm) | Withstand voltage of front dielectric layer (V) |
|---|---|---|---|---|---|---|
| 3 | 3 | 3 | 7.8 | 71 | 2.2 | 885 |
| | | 2 | 7.3 | 68 | 1.9 | 894 |
| | | 1 | 6.7 | 65 | 1.7 | 906 |
| | | Less than 1 | 6.2 | 61 | 1.4 | 915 |

Referring to Table 1 and Table 3, when the average diameters of Ru, Ag, and frit are 5 μm, the bus electrode is 13 μm thick, and when the average diameters of Ru, Ag, and frit 5 are 3 μm, the bus electrode is 7.8 μm thick. That is, as the average diameter of Ru, Ag, and frit decreases, the bus electrode thins. Further, the line resistance of the bus electrode decreases from 80Ω to 71Ω, the edge-curl value decreases from 5 μm to 2.2 μm, and the withstand voltage of the front dielectric layer increases from 850 V to 885 V.

Also, the thickness of the bus electrode, the line resistance, the edge-curl value, and the withstand voltage of the front dielectric layer of Example 2 are superior in comparison to Example 1. Generally, as the average diameter of the particles decreases, the density of the bus electrode may increase.

Additionally, when the average diameter of the frit decreases, the density of the bus electrode may increase, which is a desirable result. Further, when comparing the bus electrode thickness, line resistance, edge-curl value, and withstand voltage of the front dielectric layer of the bus electrodes of Example 2, as the average diameter of the frit decreases, these characteristics become gradually more advantageous.

EXAMPLE 3

In Example 3, bus electrodes are formed such that the average diameter of Ru and the average diameter of Ag are formed to be 2 μm, and the average diameter of the frit is formed to be less than 1 μm, 1 μm, and 2 μm.

Table 4 shows the measurement results.

TABLE 4

| Average Diameter of Ru (μm) | Average Diameter of Ag (μm) | Average Diameter of frit (μm) | Thickness of Bus electrode (μm) | Line resistance (Ω) | Edge-curl value (μm) | Withstand voltage of front dielectric layer (V) |
|---|---|---|---|---|---|---|
| 2 | 2 | 2 | 6.5 | 66 | 1.0 | 900 |
| | | 1 | 5.5 | 59 | 0.8 | 908 |
| | | Less than 1 | 5 | 52 | 0.7 | 920 |

Referring to Table 1 and Table 4, when the average diameters of Ru, Ag, and frit are 5 μm, the bus electrode is 13 μm thick, and when the average diameters of Ru, Ag, and frit are 2 μm, the bus electrode is 6.5 μm thick. That is, as the average diameter of Ru, Ag, and frit decrease, the bus electrode thins. Further, the line resistance of the bus electrode decreases from 80Ω to 66Ω the edge-curl value decreases from 5 μm to 1.0 μm, and the withstand voltage of the front dielectric layer increases from 850 V to 900 V.

The measurement results of Example 3 are superior to the measurement results of Examples 1 and 2.

Generally, as the average diameter of the particles decreases, the density of the bus electrode increases. Additionally, when comparing bus electrode thickness, line resistance, edge-curl value, and withstand voltage of the front dielectric layer of the bus electrodes of Example 3, as the average diameter of the frit decreases, these characteristics become gradually more advantageous.

EXAMPLE 4

In Example 4, bus electrodes are formed such that the average diameter of Ru and the average diameter of Ag are formed to be 1 μm, and the average diameter of frit is formed to be less than 1 μm and 1 μm.

Table 5 shows the measurement results.

TABLE 5

| Average Diameter of Ru (μm) | Average Diameter of Ag (μm) | Average Diameter of frit (μm) | Thickness of Bus electrode (μm) | Line resistance (Ω) | Edge-curl value (μm) | Withstand voltage of front dielectric layer (V) |
|---|---|---|---|---|---|---|
| 1 | 1 | 1 | 3.8 | 53 | 0.5 | 917 |
| | | Less than 1 | 3.4 | 48 | 0.4 | 926 |

Referring to Tables 1 and Table 5, when the average diameters of Ru, Ag, and frit are 5 μm, the bus electrode is 13 μm thick, and when the average diameters of Ru, Ag, and frit are 1 μm, the bus electrode is 3.8 μm thick. That is, as the average diameter of Ru, Ag, and frit decreases, the bus electrode thins. Further, the line resistance of the bus electrode decreases from 80Ω to 53Ω, the edge-curl value decreases from 5 μm to 0.5 μm, and the withstand voltage of the front dielectric layer increases from 850 V to 917 V.

The measurement results of Example 4 are superior to the measurement results of Examples 1 through 3.

Generally, as the average diameter of the particles decreases, the density of the bus electrode increases. Additionally, when comparing bus electrode thickness, line resistance, edge-curl value, and withstand voltage of the front dielectric layer of the bus electrodes of Example 4, as the average diameter of the frit decreases, these characteristics become gradually more advantageous.

EXAMPLE 5

In Example 5, bus electrodes are formed such that the average diameters of Ru, Ag, frit are formed to be less than 1 μm.

Table 6 shows the measurement results.

TABLE 6

| Average Diameter of Ru (μm) | Average Diameter of Ag (μm) | Average Diameter of frit (μm) | Thickness of Bus electrode (μm) | Line resistance (Ω) | Edge-curl value (μm) | Withstand voltage of front dielectric layer (V) |
|---|---|---|---|---|---|---|
| Less than 1 | Less than 1 | Less than 1 | 3.0 | 42 | 0.3 | 933 |

Referring to Table 1 and Table 6, when the average diameters of Ru, Ag, and frit are 5 μm, the bus electrode is 13 μm thick, and when the average diameters of Ru, Ag, and frit are less than 1 μm, the bus electrode is 3.0 μm thick. That is, as the average diameter of Ru, Ag, and frit decreases, the bus electrode thins. Further, the line resistance of the bus electrode decreases from 80Ω to 42Ω, the edge-curl value decreases from 5 μm to 0.3 μm, and the withstand voltage of the front dielectric layer increases from 850 V to 933 V.

The measurement results of Example 5 are superior to the measurement results of Examples 1 through 4.

According to exemplary embodiments of the present invention, a thin, high density bus electrode may be formed. Therefore, the low line resistance may increase the bus electrode's conductivity, and reducing pin hole generation may increase the bus electrode's productivity. Also, the withstand voltage of the front dielectric layer covering the bus electrode may be maintained since the edge-curls may be reduced, and bus electrode and dielectric layer thickness may be reduced, thereby reducing material costs.

It will be apparent to those skilled in the art that various modifications and variation can be made in the present invention without departing from the spirit or scope of the invention. Thus, it is intended that the present invention cover the modifications and variations of this invention provided they come within the scope of the appended claims and their equivalents.

What is claimed is:

1. A plasma display panel (PDP), comprising;

a front substrate; and a sustain electrode formed on the front substrate and comprising a transparent electrode and a bus electrode coupled to each other, the bus electrode comprising a first bus electrode layer formed on the transparent electrode and a second bus electrode layer formed on the first bus electrode layer, wherein the first and second bus electrode layers comprise conductive particles and adhesive particles;

wherein an average diameter of the conductive particles and an average diameter of the adhesive particles are less than 5 μm;

wherein the average diameter of the adhesive particles is equal to or less than the average diameter of the conductive particles; and wherein the total thickness of the first and second bus electrode layers does not exceed 6.5 μm.

2. The PDP of claim 1, wherein the average diameter of the conductive particles and the average diameter of the adhesive particles are in a range of 1 to 2 μm.

3. The PDP of claim 1, wherein the conductive particles of the first bus electrode layer are black.

4. The PDP of claim 3, wherein the conductive particles of the first bus electrode layer comprise Ru, Co, or Mn.

5. The PDP of claim 1, wherein the conductive particles of the second bus electrode layer are white.

6. The PDP of claim 5, wherein the conductive particles of the second bus electrode layer comprise Ag, Al, or Au.

7. The PDP of claim 1, wherein the adhesive particles are formed of a frit.

8. The PDP of claim 7, wherein the frit comprises PbO, $B_2O_3$, $SiO_2$, $Al_2O_3$, or $Bi_2O_2$.

9. The PDP of claim 1, wherein the first bus electrode layer is more than 0.4 μm thick.

* * * * *